US007475741B2

(12) United States Patent
Waters

(10) Patent No.: US 7,475,741 B2
(45) Date of Patent: Jan. 13, 2009

(54) METHOD AND SYSTEM FOR PRECISE DRILLING GUIDANCE OF TWIN WELLS

(75) Inventor: Robert Lyngle Waters, Austin, TX (US)

(73) Assignee: General Electric Company, Schenectady, NY (US)

( * ) Notice: Subject to any disclaimer, the term of this patent is extended or adjusted under 35 U.S.C. 154(b) by 287 days.

(21) Appl. No.: 10/998,781

(22) Filed: Nov. 30, 2004

(65) Prior Publication Data

US 2006/0113112 A1 Jun. 1, 2006

(51) Int. Cl.
*E21B 7/04* (2006.01)

(52) U.S. Cl. ..... 175/45; 175/61

(58) Field of Classification Search ..... 175/61, 175/73, 45; 324/326, 207.17, 346
See application file for complete search history.

(56) References Cited

U.S. PATENT DOCUMENTS

| | | | | |
|---|---|---|---|---|
| 3,725,777 | A | 4/1973 | Robinson et al. | |
| 4,072,200 | A | 2/1978 | Morris et al. | |
| 4,458,767 | A * | 7/1984 | Hoehn, Jr. | 175/61 |
| 4,465,140 | A | 8/1984 | Hoehn, Jr. | |
| 4,593,770 | A * | 6/1986 | Hoehn, Jr. | 175/45 |
| 5,064,006 | A | 11/1991 | Waters et al. | |
| 5,155,916 | A | 10/1992 | Engebretson | |
| 5,230,387 | A | 7/1993 | Waters et al. | |
| 5,398,421 | A | 3/1995 | Nicolle et al. | |
| 5,435,069 | A | 7/1995 | Nicholson | |
| 5,452,518 | A | 9/1995 | DiPersio | |
| 5,512,830 | A | 4/1996 | Kuckes | |
| 5,564,193 | A | 10/1996 | Brooks | |
| 5,923,170 | A * | 7/1999 | Kuckes | 324/326 |
| 6,152,246 | A | 11/2000 | King et al. | |
| 6,530,154 | B2 | 3/2003 | Towle | |
| 6,608,565 | B1 | 8/2003 | Van Steenwyk et al. | |
| 6,651,496 | B2 | 11/2003 | Van Steenwyk et al. | |
| 6,927,741 | B2 * | 8/2005 | Brune et al. | 343/867 |
| 2002/0112856 | A1 | 8/2002 | Van Steenwyk et al. | |
| 2003/0041661 | A1 | 3/2003 | Van Steenwyk et al. | |
| 2003/0220743 | A1 | 11/2003 | Van Steenwyk et al. | |
| 2004/0159466 | A1 | 8/2004 | Haugen et al. | |
| 2004/0160223 | A1 | 8/2004 | McElhinney | |

OTHER PUBLICATIONS

MagTraC Scientific Drilling brochure, (five pages), (prior to Jun. 2004).
MagTraC Scientific Drilling brochure, MagTraC, (one page), (Jun. 2003).

* cited by examiner

*Primary Examiner*—David J. Bagnell
*Assistant Examiner*—Brad Harcourt
(74) *Attorney, Agent, or Firm*—Nixon & Vanderhye P.C.

(57) ABSTRACT

A method to guide a drilling path of a second well in proximity to a first well including: applying a time-varying electrical current to a conductive casing or liner of the first well. From the drilling path of the second well, an electromagnetic field generated by the current in the first well is sensed. The drilling path trajectory of the second well is guided using the sensed electromagnetic field.

10 Claims, 3 Drawing Sheets

METHOD AND SYSTEM FOR PRECISE DRILLING GUIDANCE OF TWIN WELLS

BACKGROUND OF THE INVENTION

The present invention relates to the field of well drilling guidance and, in particular, to guidance systems that use electromagnetic fields associated with an existing well casing to steer the drilling of a second well proximate to the first.

There is often a need to drill a second well adjacent an existing well. For example, a pair of horizontal wells may be drilled to extract oil from a deposit of heavy oil or tar. Of the pair of wells, an upper well may inject steam into a subterranean deposit of heavy oil or tar while the lower well collects liquefied oil from the deposit. The pair of wells are to be positioned within a few meters of each other along the length of the lateral such that the oil liquefied by the steam from the first well is collected by the second well.

There is a long-felt need for methods to drill multiple wells, e.g., a pair of wells, in juxtaposition. Aligning a second well with respect to a first well is difficult. The drilling path of the second well may be specified to be within a few meters, e.g., 4 to 10 meters, of the first well, but held to within a tolerance, for example, of plus or minus 1 meter. Drilling guidance methods and system are needed to ensure that the drilling path of the second well remains properly aligned with the first well along the entire drilling path of the second well.

Surveying the drilling path at successive points along the path is a conventional drilling guidance method. A difficulty with surveying is that a cumulative error arises in the surveyed well path because small errors made at each successive survey point along the well path are introduced into the survey calculation made at subsequent survey points. The cumulative effect of these small errors may eventually cause the drilling path of the second well to drift outside the specified desired ranges of distance or direction relative to the first well.

U.S. Pat. Nos. 6,530,154; 5,435,069; 5,230,387; 5,512,830 and 3,725,777, and Published US Patent Application 2002/0112,856 disclose various drilling guidance methods and systems to provide drilling path guidance and to compensate for the cumulative effect of conventional survey errors. These known techniques include sensing a magnetic field generated by the magnetic properties of a well casing or a magnetic probe introduced into the well. These methods and systems may require the use a second rig or other device in the first well to push or pump down a magnetic signal source device. The magnetic fields from such a source are subject to magnetic attenuation and distortion by the first well casing, and may also generate a relatively weak magnetic field that is difficult to sense from the desired second well drilling path. In view of these difficulties, there remains a long felt need for a method and system to guide the trajectory of a second well such that is aligned with an existing well.

BRIEF DESCRIPTION OF THE INVENTION

A system and method have been developed to precisely guide the drilling trajectory of a second well in a manner that ensures that the second well is properly aligned with a first well. In one embodiment, a metallic casing in the first well conducts an alternating current that generates an alternating magnetic field in the earth surrounding the first well. This magnetic field is substantially more predictable in magnitude than would be a magnetic field due solely to the static magnetic properties of the first well. The intended drilling trajectory of the second well is within the measurable magnetic field generated by the current in the first well. A magnetic detector is included within the drilling assembly used for boring the second hole. The magnetic detector senses the magnetic field generated by the current in the first well. Values measured of strength and direction of the magnetic field are used to align the trajectory of the drilling assembly drilling the hole for the second well.

The system may be used to guide a second horizontal well being drilled near a first horizontal well to enhance oil production from subterranean reservoirs of heavy oil or tar sands. The two parallel wells are to be positioned one above the other and separated by a certain distance, e.g., within the range of 4 to 10 meters, through a horizontal section of a heavy oil or tar deposit. In one embodiment, the method guides a drilling path so that the second horizontal well is a consistent and short distance from the first well by: (1) causing a known electrical current to flow in the metallic casing or liner (collectively "casing") of the first well to produce a continuous magnetic field in the region about the first well, and (2) using magnetic field sensing instruments in the second well while drilling to measure and calculate accurate distance and direction information relative to the first well so that the driller can correct the trajectory of the second well and position the second well in the desired relationship to the first well.

In another embodiment the invention is a method to guide a drilling path of a second well in proximity to a first well including: applying a time-varying electrical current to a conductive casing of the first well; from the drilling path of the second well, sensing an electromagnetic field generated by the current in the first well, and guiding the drilling path trajectory of the second well using the sensed electromagnetic field.

The inventive method may be a method to guide the drilling path of a second well in proximity to a first well comprising: drilling a third well towards a distal section of the first well and establishing a conductive path along the third well to the distal section of the first well; forming an electrical circuit comprising an electrical generator, a conductive casing of the first well and the conductive path along the third well, wherein said generator applies a time-varying electrical current to the circuit; from the drilling path of the second well, sensing an electromagnetic field generated by the current in the first well, and guiding the drilling path of the second well using the sensed electromagnetic field.

The invention may also be embodied as a drilling guidance system for guiding a drilling path of a second well in proximity to a first well, said system comprising: a first conductive path extending a length of the first well; a generator of electrical current connected to opposite ends of the first well to apply current to the first conductive path, and a magnetic field sensor in the drilling path of the second well arranged to detect a field strength and direction of an electromagnetic field generated by the current applied to the first conductive path.

DETAILED DESCRIPTION OF THE INVENTION

Figure 1:
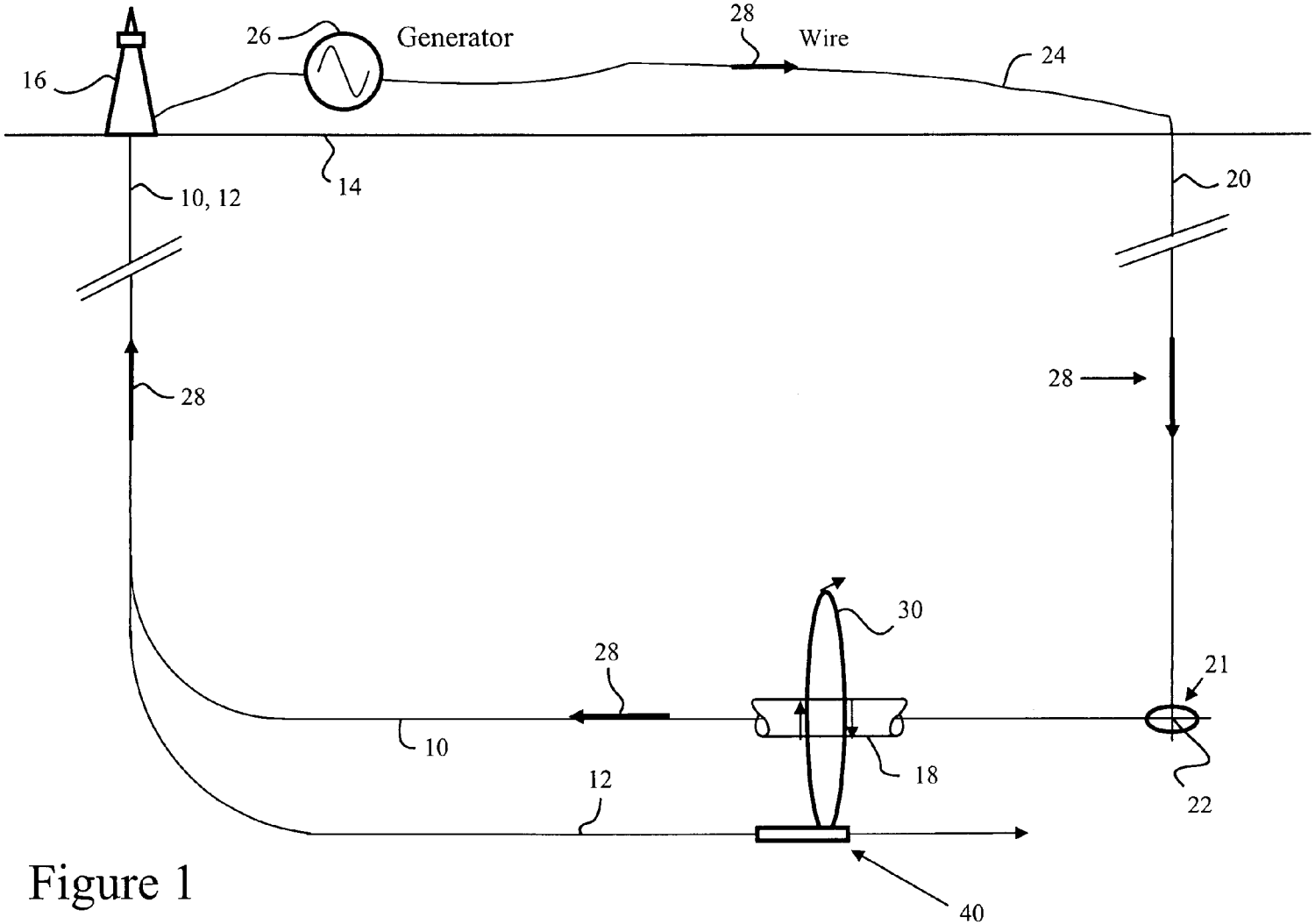
FIG. 1 is a schematic illustration of an elevation of a well plan for drilling twin horizontal wells.

FIG. 1 schematically illustrates a typical well plan for drilling twin horizontal wells 10, 12. On the ground 14 the wells may be drilled from one or two drilling platforms 16, more likely two. After initially being drilled substantially vertically, the wells are drilled horizontally into a deposit of, for example, heavy oil or tar. The first well 12 is drilled and cased before drilling commences on the second horizontal well 10. The casing or slotted liner are metallic and will conduct electricity. The horizontal portion of the first well may be above the second well by several meters, e.g., 4 to 10 meters.

A directional survey is made of the first well to map the well and facilitate planning a surface location for a small, vertical borehole 20 which is a third well. This small borehole will nearly intersect 21 the first well at the distal termination end of the first well. The small hole, with a temporary casing installed, preferably of a non-conductive material such as PVC installed, need only to be large enough to accommodate a special electrode 22 to be lowered to the bottom and near to the first casing. The small vertical hole may be similar in size to a water well and may extend a few meters deeper that the first well.

To establish a conductive path in the small well 18, a suitable conductive fluid may be pumped into the well 20. The electrode 22 is lowered into the vertical hole to provide a current path through the small well. The electrode 22 electrically connects the casing or liner 18 of the first well to a conductive path, e.g. a wire, in the small bore hole 20.

An above ground conductive path, e.g., wires 24, connects the surface ends of the third well 20 and the casing or liner 18 of the first well 10 to an alternating-current (AC) electrical generator 26. The electrical power from the generator drives a current 28 that flows through the wire 24, third well 20, electrode 22, casing or liner of the first well 18 and to the generator.

The alternating-current 28 induces an electromagnetic field 30 in the earth surrounding the casing 18 of the first well. The characteristics of an electromagnetic field from an AC conductive path are well-known. The strength of the electromagnetic field 30 is proportional to the alternating current applied by the generator. The magnitude of current in the casing may be measured with precision by an amp meter, for example. Because the strength of the magnetic fields is proportional to the current, there is a well-defined relationship between the current, measured magnetic field strength at the new well and the distance between the new well and casing of the first well. The strength and direction of the magnetic field are indicative of the distance and direction to the casing of the first well.

Figure 2:
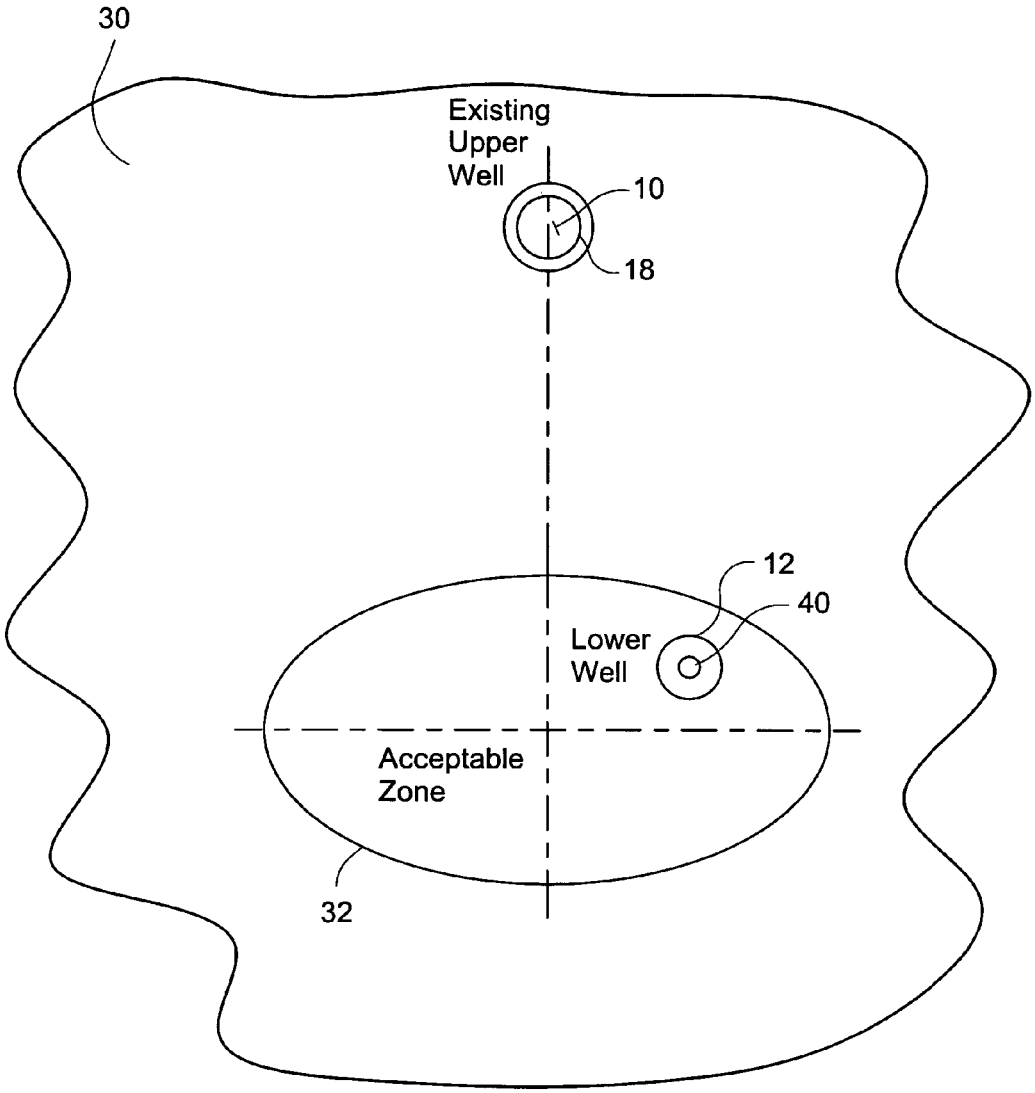
FIG. 2 is a schematic map of locations for twin horizontal boreholes and an acceptable region for the trajectory of the second well.

FIG. 2 is a schematic view of the first and second wells at a cross-sectional plane along the vertical sections through the wells. The electromagnetic field 30 emanates from the casing 18 of the fist well 10 and into the surrounding earth. The second well 12 is shown as the lower well, however the position of the first and second well may be reversed depending on the drilling application. A magnetic sensor assembly 40 in the second well senses the magnetic field.

The acceptable drilling path of the second well is defined by an acceptable zone 32 that is shown in cross-section in FIG. 2. The acceptable zone 32 may be a region that is usually centered in the range of 4 to 10 meters below the first well. The zone 32 may have a short axis along a radius drawn from the upper well and a long axis perpendicular to a vertical plane through the upper well. The dimensions of the acceptable zone may be one meter along the short axis and two meters along the long axis of the zone. The shape and dimensions of the acceptable zone are known for each drilling application, but may differ depending on the application.

The drilling trajectory for the second well should remain in the acceptable zone 32 for the entire length of the horizontal portion of the two wells. The drilling guidance system, which includes the sensor assembly 40, is used to maintain the drilling trajectory of the second well within the acceptable zone. Whether the drilling trajectory of the second well 12 is within the acceptable zone 32 is determined based on the direction and strength of the electromagnetic field 30 along the second well path as sensed by the magnetic sensor assembly 40. Measurements of the field intensity and field direction by the sensor assembly 40, in the second well provide information sufficient to determine the direction to the first well and the distance between the two wells. This information is provided to the driller in a convenient form so that he can take appropriate action to maintain the trajectories of the two wells in the proper relationship. The sensor assembly 40 is incorporated into the down hole probe of a wireline steering tool or MWD system for drilling the second well 12. The sensor assembly thus guides the drilling of the second well for directional control of the drill path trajectory.

As current flows in the conductive casing 18 of the first well, the quasistatic or alternating electromagnetic fields produced in the region surrounding the conductor are predictable in terms of their field strength, distribution and polarity. The magnetic field (B) produced by a long straight conductor, such as the well casing, is proportional to the current (I) in the conductor and inversely proportional to the perpendicular distance (r) from the conductor. The relationship between magnetic field, current and distance is set forth in Biot-Savart's Law which states:

$$B=u_r I/(2\Pi r)$$

Where $u_r$ is the magnetic permeability of the region surrounding the conductor and is constant. The distance (r) of the second bore hole from the casing of the first well can thus be determined based on the measurement of the current (I) in the casing and the magnetic field strength (B) at the second bore hole.

Figure 3:
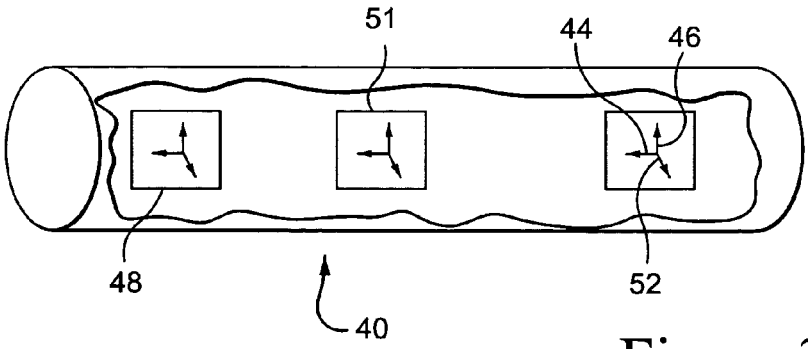
FIG. 3 is a schematic diagram of an exemplary magnetic sensor array.

FIG. 3 is a schematic diagram of a component-type magnetic sensor assembly 40 (shown in a cut-away view) having the ability to discriminate field direction. Component-type magnetic sensors, e.g., magnetometers and accelerometers, are directional and survey sensors conventionally included measurement-while-drilling (MWD) sensors. The sensor assembly 40 moves through the second bore hole typically a few yards behind the drill bit and associated drilling equipment. The sensor assembly 40 collects data used to determine the location of the second bore hole. This information issues to guide the drill bit along a desired drilling trajectory of the second well.

The sensor assembly 40 also includes standard orientation sensors (three orthogonal magnetometers 48 and three orthogonal accelerometers 51, and three orthogonal alternating-field magnetic sensors 44, 46, 52 for detection of the electro magnetic field about the first (reference) well. The magnetic sensors, have a component response pattern and are most sensitive to alternating magnetic field intensity corresponding to the frequency of the alternating current source. These sensors are mounted in a fixed relative orientation in the housing for the sensor assembly.

A pair of radial component-magnetic sensors 44 and 46 (typically two or three sensors) are arranged in the probe assembly 40 such that their magnetically sensitive axes are mutually orthogonal. Each component sensor 44, 46 measures the relative magnetic field (B) strengths at the second well. The sensors will each detect different field strengths due to their orthogonal orientations. The direction on the field (B) may be determined by the inverse tangent ($\tan^{-1}$) of the ratio of the field strength sensed by the radial sensors 44, 46. The frame of reference for the radial sensors 44, 46 is the earth's gravity and magnetic north, determined by the magnetic sensors 48 and the gravity sensors. The direction to the conductor of current is calculated by adding 90 degrees to the direction of the field at the point of measurement. The direction from the sensors to the first well and the perpendicular distance between the sensors and the first well, provides sufficient information to guide the trajectory of the second well in the acceptable zone 32.

Figure 4:
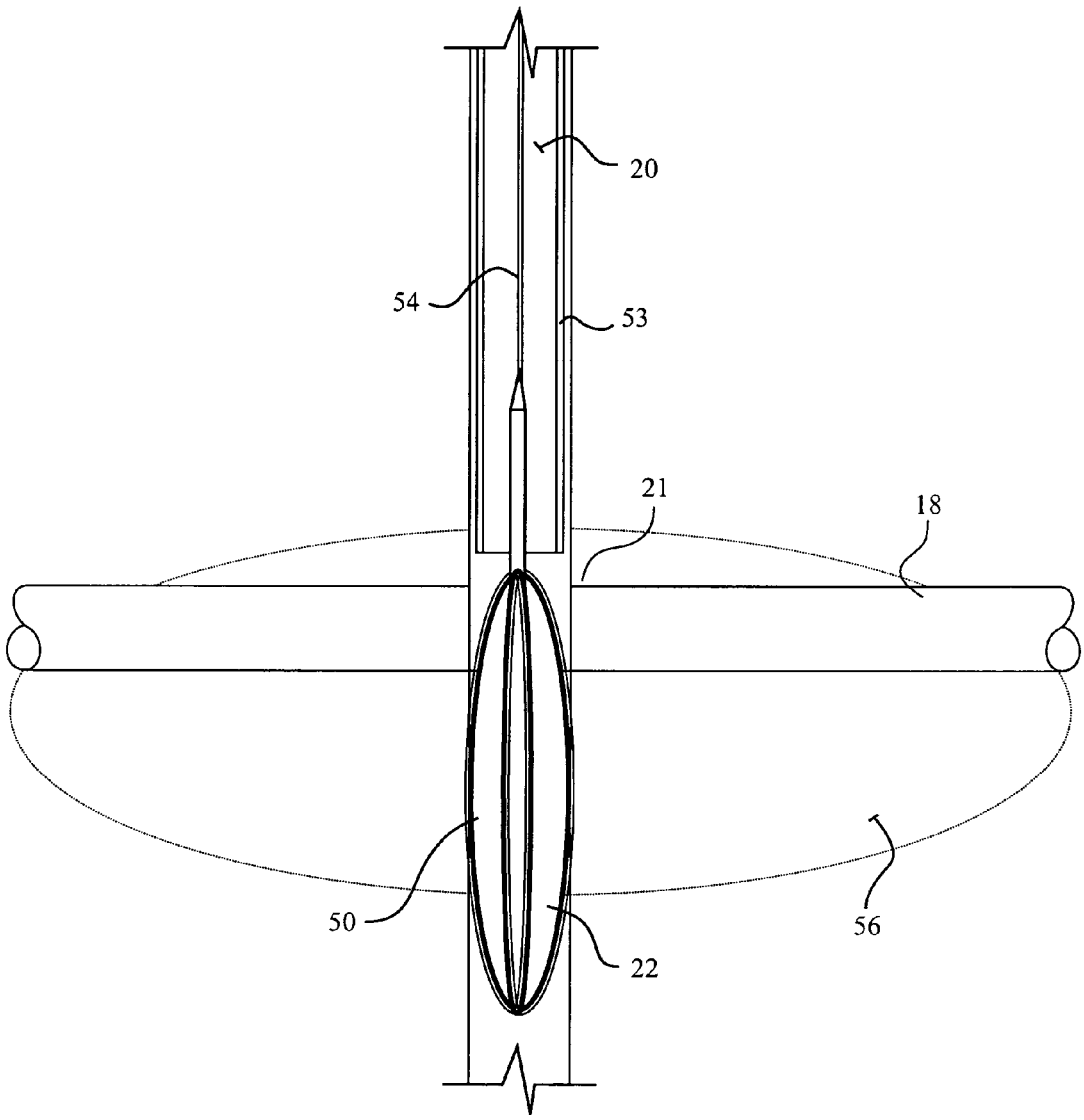
FIG. 4 is a side view of an exemplary electrode in the third well that provides electrical contact to the first well.

FIG. 4 is a schematic illustration of an exemplary electrode 22 lowered into the small vertical hole 20 to the zone where the conductive fluid has been introduced. The electrode 22 includes metallic springs 50 e.g., an expandable mesh, that expand to contact the walls of the open borehole of the well 20. The spring elements 50 may be retracted to a size which slides through the temporary casing 53 of the vertical well 20. The temporary casing insures that the material around the borehole does not slough into the hole. The electrode 22 is positioned near the first casing 18 at the intersection 21 of the two wells. A conductive fluid in the third well 20 seeps into the earth 56 surrounding the intersection 21 between wells. The conductive fluid enhances the electrical connectivity between the first casing and third well. The electrode is connected to the insulated conductor wire 54 that extends through the well 20 and to the surface. The wire 54 is connected via wire 24 to the return side of the generator.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to guide a drilling path of a second well in proximity to a first well comprising:

applying a varying electrical current to a conductive casing or liner of the first well;

drilling a second well along a drilling trajectory;

from the second well, sensing an electromagnetic field generated by the current in the first well, and guiding the drilling trajectory of the second well using the sensed electromagnetic field;

wherein applying the current further comprises drilling a third well to a distal end of the first well and forming a conductive path between the distal end of the first well and along the third well to a source of the current.

2. A method to guide a drilling path of a second well in proximity to a first well comprising:

applying a varying electrical current to a conductive casing or liner of the first well;

drilling a second well along a drilling trajectory;

from the second well, sensing an electromagnetic field generated by the current in the first well, and guiding the drilling trajectory of the second well using the sensed electromagnetic field;

wherein applying the current further comprises drilling a third well to a distal end of the first well, and placing into the third well a conductive fluid to establish a conductive path between the distal end of the first well and a source of the current.

3. A method to guide a drilling path of a second well in proximity to a first well comprising:

drilling a third well towards a distal section of the first well and establishing a conductive path along the third well to the distal section of the first well;

forming an electrical circuit comprising an electrical generator, a conductive casing or liner of the first well and the conductive path along the third well, wherein said generator applies a varying electrical current to the circuit;

from the drilling path of the second well, sensing an electromagnetic field generated by the current in the first well, and guiding the drilling path of the second well using the sensed electromagnetic field.

4. The method in claim 3 wherein the applied current is an alternating current (AC).

5. The method in claim 3 wherein the first well is horizontal and the drilling path of the second well is horizontal along a portion guided by the sensed electromagnetic field.

6. The method in claim 3 wherein the electromagnetic field is sensed by a pair of orthogonal magnetic sensors in the second drilling path and said method further comprises determining a distance between the sensors and the first well and a direction from the sensors to the first well.

7. The method in claim 3 wherein the generator is an above-ground alternating-current electrical generator.

8. A drilling guidance system for guiding a drilling path of a second well in proximity to a first well, said system comprising:

a first conductive path extending a length of the first well;

a generator of electrical current connected to opposite ends of the first well to apply current to the first conductive path;

a magnetic field sensor in the drilling path of the second well arranged to detect a field strength and direction of an electromagnetic field generated by the current applied to the first conductive path, and a third well extending from a ground surface to a proximity of a distal portion of the first well and a further conductive path along the third well, wherein the further conductive path is electrically connected to the generator and the distal portion of the first well.

9. The system in claim 8 wherein said further conductive path comprises an electrode electrically coupled to the distal portion of the first well.

10. The system in claim 9 wherein said electrode further comprises expandable spring contacts to engage the third well.

* * * * *